US012808538B2

(12) United States Patent
Farley et al.

(10) Patent No.: US 12,808,538 B2
(45) Date of Patent: Nov. 24, 2026

(54) COUNTER-FLOW HEAT REDUCTION CYCLE

(71) Applicant: Rheem Manufacturing Company, Atlanta, GA (US)

(72) Inventors: Darryl Farley, Fayetteville, AR (US); Nathan Whalen, Alma, AR (US)

(73) Assignee: Rheem Manufacturing Company, Atlanta, GA (US)

( * ) Notice: Subject to any disclaimer, the term of this patent is extended or adjusted under 35 U.S.C. 154(b) by 390 days.

(21) Appl. No.: 18/425,559

(22) Filed: Jan. 29, 2024

(65) Prior Publication Data

US 2024/0263780 A1 Aug. 8, 2024

Related U.S. Application Data

(60) Provisional application No. 63/442,862, filed on Feb. 2, 2023.

(51) Int. Cl.
*F23N 5/20* (2006.01)

(52) U.S. Cl.
CPC ..... *F23N 5/203* (2013.01); *F23N 2227/06* (2020.01); *F23N 2233/06* (2020.01)

(58) Field of Classification Search
CPC ..... F23N 5/203; F23N 2227/06
See application file for complete search history.

(56) References Cited

U.S. PATENT DOCUMENTS 2,671,503 A * 3/1954 Logan ..... F23N 5/203 431/31
3,105,432 A * 10/1963 Chamberlain ..... F24C 15/002 126/85 B
3,274,989 A * 9/1966 Jenson ..... F24H 3/065 126/116 B
3,428,040 A * 2/1969 Baker ..... F24C 3/004 126/307 R
3,552,377 A * 1/1971 Hodges ..... F24C 15/002 126/307 R
3,726,267 A * 4/1973 Cavestany ..... F24C 3/004 126/307 R (Continued)

FOREIGN PATENT DOCUMENTS

CN 110546434 B * 7/2022 ..... F24H 3/087
JP H09178343 A * 7/1997

(Continued)

*Primary Examiner* — Jorge A Pereiro
(74) *Attorney, Agent, or Firm* — Eversheds Sutherland (US) LLP

(57) ABSTRACT

Systems and methods for counter-flow heat reduction cycles are disclosed. Embodiments may include a gas furnace having a combustion air pipe, an exhaust air pipe, and a heat exchanger coupled to the combustion air pipe and the exhaust air pipe, the heat exchanger having a heat exchanger tube and an induced draft blower configured to direct air toward the heat exchanger tube, where the air flows over the heat exchanger tube and into the exhaust air pipe. The gas furnace may include a controller configured to determine a call for heat, activate the induced draft blower during a normal heating operation, determine that the call for heat is no longer present, determine that at least 70 seconds have elapsed since determining that the call for heat is no longer present, and deactivate the induced draft blower.

16 Claims, 6 Drawing Sheets

(56) References Cited

U.S. PATENT DOCUMENTS 3,912,162 A * 10/1975 Bauer ..... G05D 23/19 236/11
3,994,280 A * 11/1976 Winters ..... F23L 17/04 126/307 A
4,138,986 A * 2/1979 Combs ..... F23C 3/00 431/185
4,369,916 A * 1/1983 Abbey ..... F24F 11/72 236/11
4,603,681 A * 8/1986 Clawson ..... F24H 8/003 126/110 R
4,684,060 A * 8/1987 Adams ..... F23N 5/203 236/11
4,688,547 A * 8/1987 Ballard ..... F23N 1/022 126/116 A
4,706,881 A * 11/1987 Ballard ..... F23N 1/022 236/15 C
4,726,353 A * 2/1988 Clawson ..... F24H 1/41 261/153
4,792,089 A * 12/1988 Ballard ..... F23N 5/242 236/11
4,995,375 A * 2/1991 Jackson ..... F24H 8/006 110/203
5,749,355 A * 5/1998 Roan ..... F24H 8/00 126/110 R
6,044,835 A * 4/2000 Brown ..... F23M 11/00 126/307 A
8,327,836 B2 * 12/2012 Brown ..... F23L 17/04 126/307 A
9,500,386 B1 * 11/2016 Walsh ..... G05D 23/1951
9,797,405 B1 * 10/2017 Mowris ..... F01D 21/003
11,187,425 B2 * 11/2021 Mowris ..... F24F 11/755
2014/0191050 A1 * 7/2014 Walsh ..... G05D 23/1951 237/50
2016/0245544 A1 * 8/2016 Walsh ..... F24F 11/81
2017/0115025 A1 * 4/2017 Mowris ..... F24D 19/1087
2017/0268797 A1 * 9/2017 Mowris ..... F24H 9/2064
2018/0038611 A1 * 2/2018 Lau ..... G05D 23/1931
2018/0292102 A1 * 10/2018 Mowris ..... F24F 11/46

FOREIGN PATENT DOCUMENTS

KR 100740830 B1 * 7/2007 ..... F24H 9/2035
WO WO-2018152394 A1 * 8/2018 ..... F24H 3/087

* cited by examiner

COUNTER-FLOW HEAT REDUCTION CYCLE

CROSS-REFERENCE TO RELATED APPLICATION

This application claims the benefit of U.S. Application No. 63/442,862, filed Feb. 2, 2023, the entirety of which is hereby incorporated by reference.

FIELD

This disclosure relates generally to gas furnaces, and more particularly to post-purge in the gas furnaces.

BACKGROUND

Heating, ventilating, and air conditioning (HVAC) equipment is typically used to heat, cool, and ventilate buildings and other enclosed spaces where people live and work. Air conditioning units are commonly used to provide cooling during summer. Often, in addition, gas furnaces may be packaged separately or with air conditioning units and the gas furnaces are commonly operated during winter to provide heating. Further, ultra-low NOx (ULN) gas furnaces are a type of non-condensing furnaces which use a premix manifold and often encounter debris collection in burner assembly thereof. Therefore, a filter is disposed within the gas furnace to filter combustion air entering the premix manifold. For purposes of cost effectiveness, the filter is often made of plastic that can be removed, cleaned, and reinserted. The combustion air for such furnaces is pulled in from a closet, an attic, or a basement in which the furnace is installed. This arrangement is referred to as indirect vent.

Condensing furnaces are kind of high-efficiency furnaces with a secondary heat exchanger that condenses hot exhaust gases in order to extract waste heat before it is vented to outside environment. Condensing furnaces are often located indoors. For condensing heat exchangers, combustion air is suctioned through a pipe vented directly from the exterior of the building. This arrangement is referred to as direct vent. As such, the gas furnace and venting pipes are exposed to outdoor winds. In a windy condition, winds from the outside environment can force exhaust gas and the combustion air back into the gas furnace via exhaust pipe and inlet pipe, respectively, in an off cycle of the gas furnace. In cases where such reverse flow takes place within the heat exchanger immediately after a heating cycle, the reverse flow of exhaust gases may reach the filter and cause melting of the filter.

In light of the above mentioned shortcomings of conventional gas furnaces, there is a need for a gas furnace to address such instances of reverse flow while maximizing the efficiency of the gas furnace.

BRIEF DESCRIPTION OF THE DRAWINGS

The detailed description is set forth with reference to the accompanying drawings. In some instances, the use of the same reference numerals may indicate similar or identical items. Various embodiments may utilize elements and/or components other than those illustrated in the drawings, and some elements and/or components may not be present in various embodiments. Throughout this disclosure, depending on the context, singular and plural terminology may be used interchangeably.

DETAILED DESCRIPTION

Figure 1:
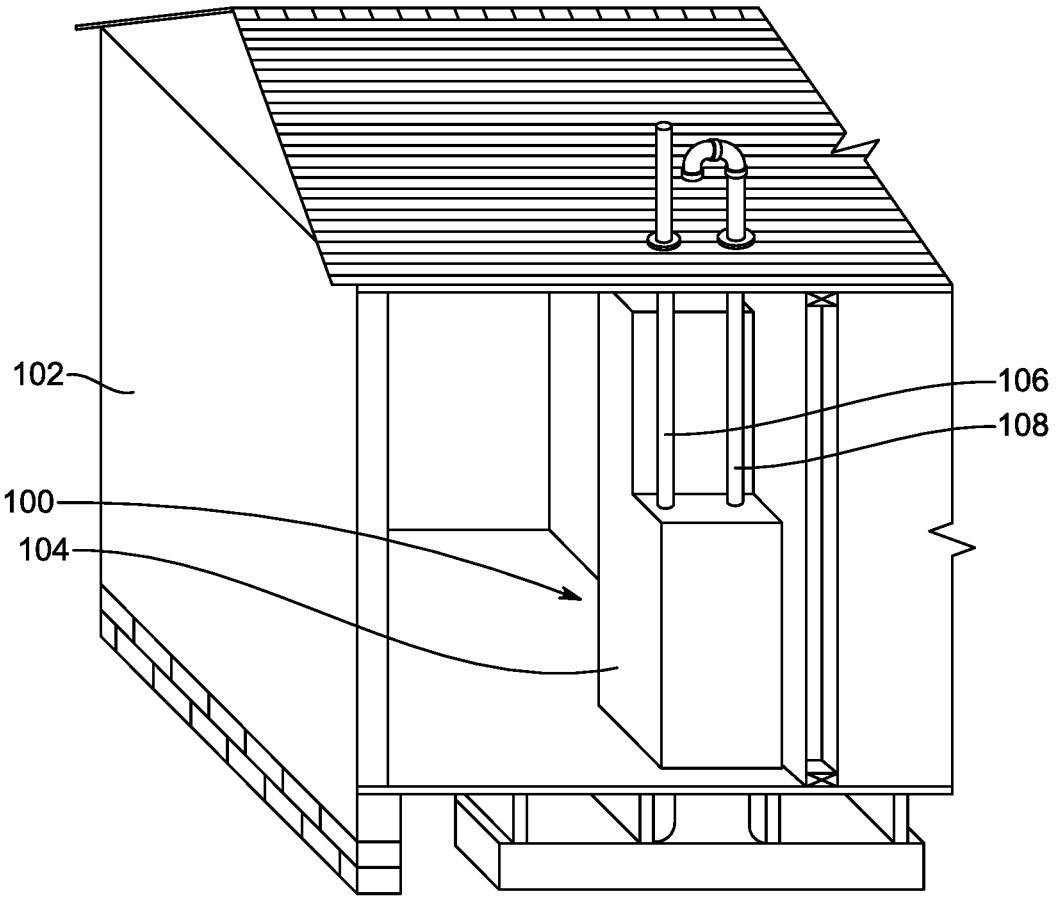
FIG. 1 illustrates a gas furnace with a direct venting arrangement where vent pipes extend vertically from the gas furnace.

This disclosure relates generally to a gas furnace. As a result of reverse flow of exhaust and flue gas in the gas furnace caused due to forced wind from outside environment entering an exhaust pipe of the gas furnace, the exhaust gas may travel in a reverse direction through heat exchanger tubes of the gas furnace and encounter a filter disposed in proximal to a premix chamber. In cases where the filter is made of plastic, the filter may be subjected to melting due to hot exhaust gas flowing thereacross. As such, the gas furnace may operate less efficiently during subsequent cycles.

To address such issues, the present disclosure provides a post-purge process where blower cool down cycle and inducer cool down cycle may be prolonged to reduce flue temperature to a value less than a melting point of the material of the filter, so that the gas furnace may not experience issues during instances of such reverse flow of exhaust and flue gas.

In some embodiments, the gas furnace includes a combustion air pipe, an exhaust air pipe, and a heat exchanger coupled to the combustion air pipe and the exhaust air pipe. The heat exchanger includes a heat exchanger tube and a blower configured to direct air toward the heat exchanger tube. The blower may be an induced draft blower, which may be distinguished from the indoor blower motor of the gas furnace. In typical implementation, the indoor blower motor might be used for directing air; however, this has a number of drawbacks, including decreased fuel utilization efficiency ratings. In contrast, the use of an induced draft blower, as described herein, provides the benefit of improved fuel utilization efficiency ratings. Moreover, use of the indoor blower motor results in blowing cold air over the heat exchanger exterior, but has another negative impact of continuing to blow cold air into the conditioned space after a heating cycle. Accordingly, embodiments may include an induced draft blower. The air flows over the heat exchanger tube and into the exhaust air pipe. The gas furnace also includes a controller configured to determine a call for heat, activate the blower during a normal heating operation, determine that the call for heat is no longer present, determine that at least 70 seconds have elapsed since determining that the call for heat is no longer present, and deactivate the blower.

In another embodiment, a fuel-fired heating appliance includes a combustion air pipe, an exhaust air pipe, and a heat exchanger coupled to the combustion air pipe and the exhaust air pipe. The heat exchanger includes a heat exchanger tube and an induced draft blower configured to direct air toward the heat exchanger tube. The air flows over the heat exchanger tube and into the exhaust air pipe. The gas furnace also includes a controller configured to determine a call for heat, activate the induced draft blower during a normal heating operation, determine that the call for heat is no longer present, determine that at least 70 seconds have elapsed since determining that the call for heat is no longer present, and deactivate the induced draft blower. An elapsed time of 70 seconds may allow for four complete cycles to be completed, as well as an additional buffer time of approximately 50 seconds. For example, most furnaces have a cycle time of 5 seconds, and typically four cycles may be completed prior to shut off. However, embodiments may extend beyond the completion of four cycles by at least 40 seconds, at least 50 seconds, at least 60 seconds, and so forth, so as to prevent melting of mesh covers.

Purge operation is a safety operation to clear the heat exchanger of all flue product and or residual gas. Purge timing results in exchanging the volume of air in the heat exchanger a certain number of times, such as four times, which results in a duration of 20 seconds if each instance lasts 5 seconds. Purge is executed before and after a heating cycle and normally is executed at the bare minimum to increase efficiency of a furnace. Any heat loss out of the flue is considered heat loss and lowers the annual fuel utilization efficiency of the unit. However, even at the minimum, some units may have residual heat in the heat exchanger after the heat cycle and after the post purge time. As a result, increasing the post purge time from a standard (e.g., 20 seconds, etc.) to 70 seconds results in evacuation of as much heat from the heat exchanger, and further reduces a likelihood of melting the filter in a reverse airflow condition. Accordingly, some embodiments use 70 seconds, which does not significantly diminish annual fuel utilization efficiency metrics, and also evacuates excess heat more thoroughly. In addition, the furnace may therefore be more efficient by overcoming the losses from running the induced draft motor past the standard purge time.

In yet another embodiment, a method for operation of an ultra-low NOx gas furnace includes the steps of determining, by a controller, a call for heat; activating an induced draft blower of the gas furnace during a normal heating operation; determining that the call for heat is no longer present; determining that at least 70 seconds have elapsed since determining that the call for heat is no longer present; and deactivating the induced draft blower.

FIG. 1 illustrates a gas furnace 100 located within a structure 102, such as a house, according to an aspect of the present disclosure. In some examples, the structure 102 may be any building, such as an office or a shop. The gas furnace 100 includes a cabinet 104, a combustion air pipe 106, and an exhaust air pipe 108. The combustion air pipe 106 and the exhaust air pipe 108 extend from the cabinet 104 to an outdoors environment as shown in FIG. 1. As such, combustion air is supplied to the cabinet 104 from the outdoors environment via the combustion air pipe 106 and exhaust or flue gas is released to the outdoors environment from the cabinet 104 via the exhaust air pipe 108. Such an arrangement is referred to as a direct vent. Other embodiments may have different configurations and/or may include additional, fewer, or different components. Some components may not be depicted at scale relative to other drawings.

Figure 2A:
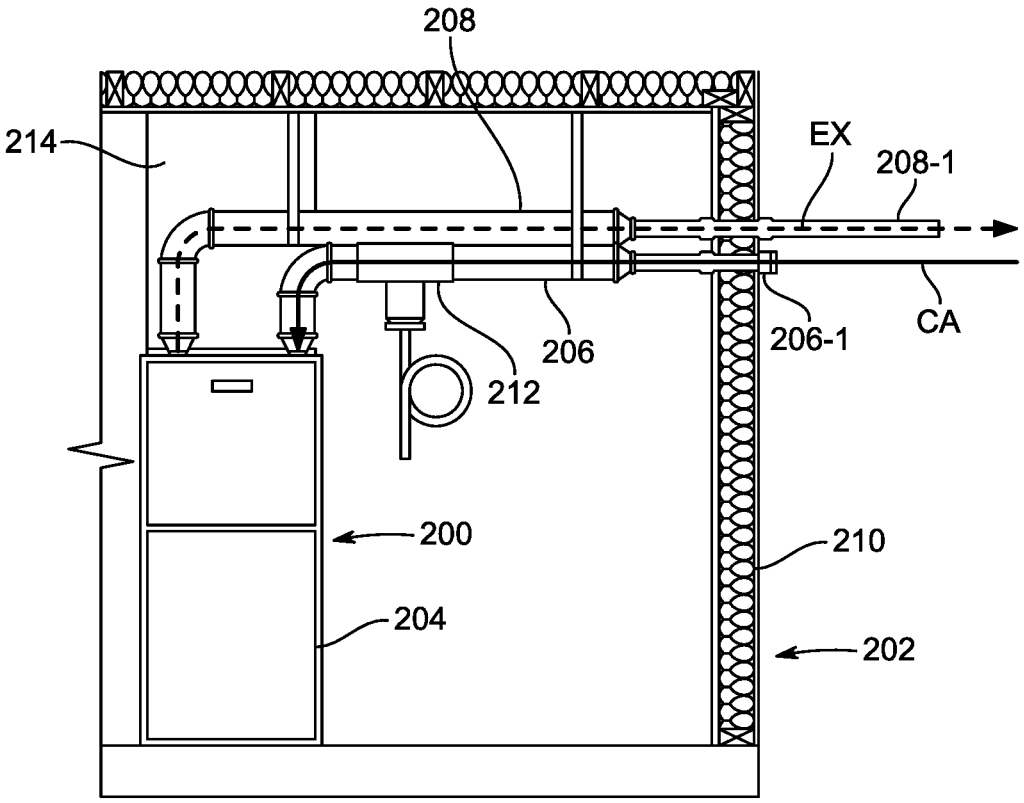
FIG. 2A illustrates a gas furnace with a direct venting arrangement where vent pipes extend horizontally from the gas furnace, in accordance with one or more embodiments of the disclosure.

FIG. 2A illustrates a gas furnace 200 located within a structure 202, such as a house, according to an aspect of the present disclosure. The gas furnace 200 is alternatively referred to as "fuel-fired heating appliance" in the present disclosure. In other embodiments, the fuel-fired heating appliance could be any fuel-fired heating appliance instead of the gas furnace described as an example herein. In some embodiments, the fuel-fired heating appliance may include the gas furnace 200 among other components thereof. According to an aspect of the present disclosure, the fuel-fired heating appliance is an ultra-low NOx (ULN) gas furnace (e.g., appliances that satisfy certain metrics such as 14 ng/J NOx requirements, etc.). Other embodiments may be furnaces having a premix system with a mesh closed burner. In particular, hydrogen-based furnaces may not be low NOx, and may instead be premix systems on which the described heat reduction cycle may be implemented. The gas furnace 200 includes a cabinet 204, a combustion air pipe 206, and an exhaust air pipe 208. The combustion air pipe 206 and the exhaust air pipe 208 extend from the cabinet 204 to an outdoors environment horizontally in contrast to a vertical arrangement shown in FIG. 1. Each of the combustion air pipe 206 and the exhaust air pipe 208 are routed through holes formed in a wall 210 of the structure 202. The combustion air pipe 206 includes an inlet 206-1 and is configured to direct air inward via the inlet 206-1 in a horizontal direction from the outdoors environment. In some embodiments, the gas furnace 200 also includes an air inlet filter 206-2 (shown in FIG. 2B) configured to filter air flowing through the combustion air pipe 206 and prevent dust/contaminants from entering a burner assembly of the gas furnace 200. The air inlet filter 206-2 (for example, a venturi air inlet filter) may be a plastic filter having a melting point temperature (e.g., 120-130 degrees Celsius, etc.) and may be located on top of a venturi housing in a burner compartment. Fresh combustion air (referenced as "CA" in FIG. 2A) from the outdoors environment flows through the combustion air pipe 206 to support combustion within the cabinet 204. In some embodiments, the combustion air pipe 206 may include a T-connector 212 (for example, a 2 inches or 3 inches T-connector) that functions as a condensation drain trap to collect condensate formed from the air flowing through the combustion air pipe 206. The gas furnace 200 also includes a supply air duct 214 that extends from the cabinet 204 and into an interior (such as a living space) of the structure 202. The exhaust air pipe 208 includes a terminal end 208-1 that is disposed adjacent (e.g., above, next to, below, along adjacent horizontal planes, etc.) to the inlet 206-1 of the combustion air pipe 206. The exhaust air pipe 208 is configured to direct exhaust gas or flue gas (referenced as "EX" in FIG. 2A) out of the terminal end 208-1 in a horizontal direction to the outdoors environment. This arrangement is also referred to as the direct vent. As such, FIG. 1 and FIG. 2 illustrates vertical and horizontal vent termination arrangements for direct vent configuration of gas furnaces, respectively.

Figure 2B:
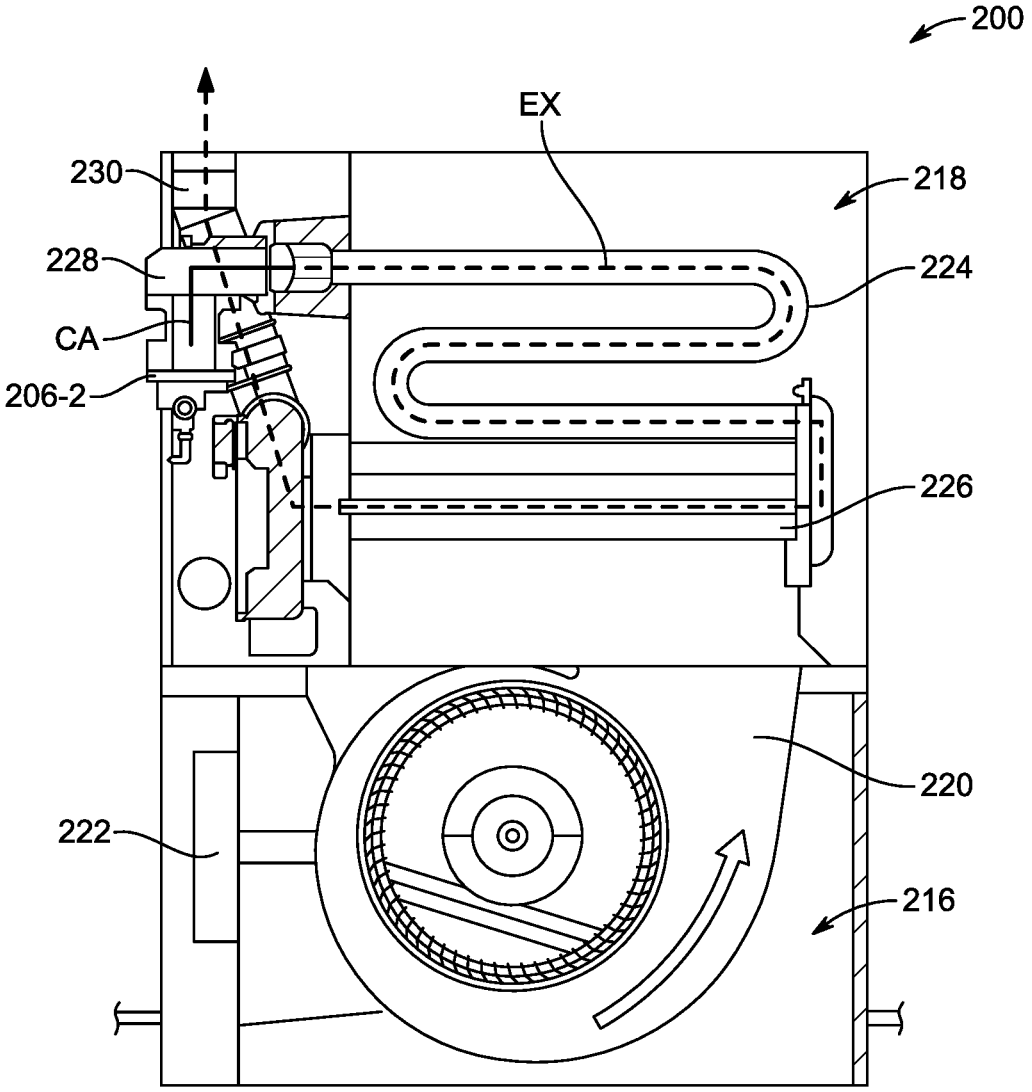
FIG. 2B illustrates a cross-section of the gas furnace of FIG. 2 subjected to a normal heating operation, in accordance with one or more embodiments of the disclosure.

FIG. 2B illustrates a cross-section of the gas furnace 200. In particular, FIG. 2B illustrates a normal heating operation of the gas furnace 200, according to an aspect of the present disclosure. The gas furnace 200 includes a first section 216 and a second section 218 located vertically above the first section 216. The first section 216 houses, among other components, an induced draft blower 220 and a controller 222. In other embodiments, the controller 222 may be disposed elsewhere, such as another section or in a remote environment. Typically, the controller 222 is embodied as a control panel or a circuit board and is configured to monitor various operational parameters of the gas furnace 200 and control the operation of the gas furnace 200. In some embodiments, the controller 222 may be a computing device capable of executing predefined instructions. In certain implementations, the computing device may be a physical device or a virtual device. In many implementations, the computing device may be any device capable of performing operations, such as a dedicated processor, a portion of a processor, a virtual processor, a portion of a virtual processor, a portion of a virtual device, or a virtual device. In some implementations, the processor may be a physical processor or a virtual processor. In some implementations, a virtual processor may correspond to one or more parts of one or more physical processors. In some implementations, instructions/logic may be distributed and executed across one or more processors, virtual or physical, to execute the instructions/logic.

The processor includes RAM, ROM, input/output (I/O) module, and a memory. Software may be stored within a memory thereof to provide instructions to the processor(s) for enabling an integral system thereof to perform various functions. For example, the memory may store software used by the integral system, such as an operating system, application programs, and associated databases. The processor and its associated components may allow the integral system to run a series of computer-readable instructions to analyze the operational parameters of the gas furnace 200. In addition, the processor may determine an optimized process to operate various components of the gas furnace 200. In some implementations, the processor may operate in a networked environment supporting connections to one or more remote clients, such as terminals, PC clients and/or mobile clients of mobile devices.

Herein, the memory may be volatile memory and/or non-volatile memory. The memory may be coupled for communication with a processing unit. The processing unit may execute instructions and/or code stored in the memory. A variety of computer-readable storage media may be stored in and accessed from the memory. The memory may include any suitable elements for storing data and machine-readable instructions, such as read only memory, random access memory, erasable programmable read only memory, electrically erasable programmable read only memory, a hard drive, a removable media drive for handling compact disks, digital video disks, diskettes, magnetic tape cartridges, memory cards, and the like.

The second section 218 of the gas furnace 200 houses, among other components, a first heat exchanger 224, a second heat exchanger 226, the burner assembly (among which one burner 228 is illustrated in the cross-section), an exhaust duct 230 that is in fluid communication with the exhaust air pipe 208 and a draft inducer (not shown). The combustion air "CA" from the outdoors environment flows into a burner manifold (not shown) of the gas furnace 200. The draft inducer is fluidly connected to each of the second heat exchanger 226, the first heat exchanger 224, and the burner manifold. In the present disclosure, the first heat exchanger 224 and the second heat exchanger 226 are together referred to as "the heat exchanger" and corresponding tubes are collectively referred to as "heat exchanger tubes". In an embodiment, the heat exchanger is a condensing heat exchanger.

In the normal heating operation, upon supply of power, the controller 222 is configured to determine a call for heat from the interior of the structure 202. For example, the call for heat may be provided in form of a manual input by a user located in the interior of the structure 202 or may be an automatic input from another controller, e.g., thermostat, (or a combination of controller and temperature sensor) located in the interior of the structure 202. Based on such call for the heat, the controller 222 actuates the draft inducer to suction the combustion air "CA" from the burner manifold through the first heat exchanger 224 and the second heat exchanger 226. Simultaneously, the controller 222 operates the burner 228 to combust a mixture of fuel (for example, propane gas) and the combustion air "CA". Owing to the suction produced by the draft inducer, the products of combustion and heated combustion air flows through the heat exchanger tubes of each of the first heat exchanger 224 and the second heat exchanger 226. Subsequently, the products of combustion (flue gas) are exhausted to the outdoors environment via the exhaust duct 230 and the exhaust air pipe 208. After a predefined time period from start of the combustion, such as 75 seconds or another length of time, the controller 222 is configured to activate the induced draft blower 220 to direct return air towards and across the heat exchanger tubes of each of the first heat exchanger 224 and the second heat exchanger 226, thereby allowing the return air to absorb heat from the heat exchanger tubes. Further, the heated return air is supplied into the interior (such as the living space) of the structure 202 via the supply air duct 214. As used herein, the term "return air" refers to the air flowing into the first section 216 of the gas furnace 200 via a return duct (not shown) that extends between the interior of the structure 202 and the first section 216 of the gas furnace 200.

Once the interior of the structure 202 has reached a desired temperature, the controller 222 is configured to determine that the call for heat is no longer present. Further, the controller 222 is configured to determine that at least a predefined time period has elapsed since determining that the call for heat is no longer present. In some embodiments, the controller 222 may be configured to receive inputs from temperature sensors (or, thermostat) located in the interior of the structure 202, where the inputs are indicative of value of temperature of the interior of the structure 202. When the value of the temperature of the interior of the structure 202 is at least equal to a desired temperature value set by the user, the controller 222 may be configured to determine such condition as "call for heat is no longer present". After a lapse of the predefined time period from a time of determining that the call for heat is no longer present, the controller 222 is configured to deactivate the induced draft blower 220.

Figure 3:
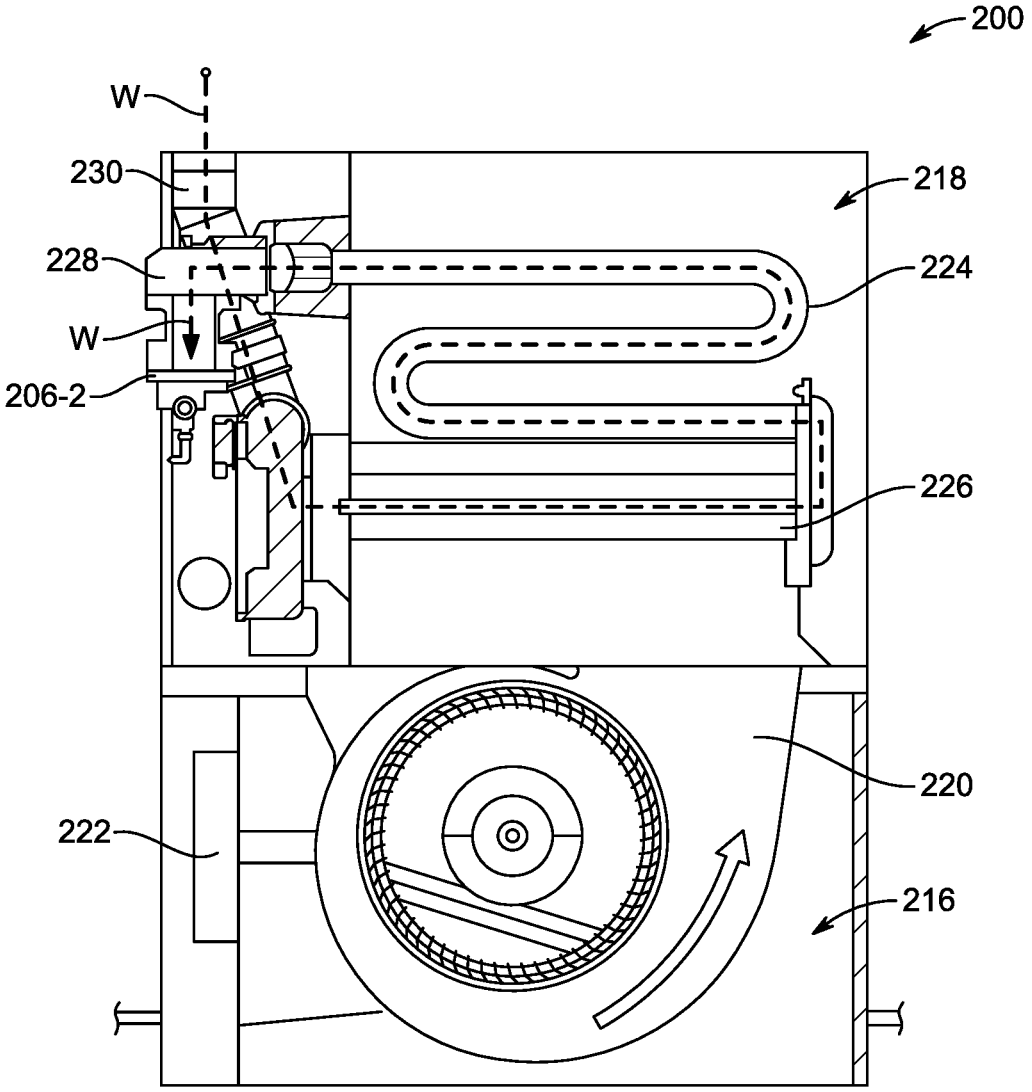
FIG. 3 illustrates a cross-section of the gas furnace of FIG. 2 subjected to reverse flow of exhaust gas through the gas furnace due to forced wind during an off cycle of the gas furnace, in accordance with one or more embodiments of the disclosure.

FIG. 3 illustrates the cross-section of the gas furnace 200 depicting flow of forced wind through the gas furnace 200 during an off cycle, according to an aspect of the present disclosure. In scenarios where high velocity wind prevails in the outdoors environment, the wind may by virtue of momentum associated therewith, flow through the exhaust air pipe 208 and may subsequently flow through the draft inducer, the second heat exchanger 226, the first heat exchanger 224, the burner assembly, and the combustion air pipe 206. Therefore, in such conditions, the wind forces the exhaust gas backward (referenced as "W" in FIG. 3) through the heat exchangers and across the air inlet filter 206-2. Since the exhaust gas is associated with high temperature, flow of the exhaust gas across the air inlet filter 206-2 may affect the functionality of the air inlet filter 206-2. According to an aspect of the present disclosure, the controller 222 is configured to maintain the induced draft blower 220 in an activated condition for about 70 seconds (e.g., 65 seconds, 66 seconds, 67 seconds, 68 seconds, 69 seconds, 71 seconds, 72 seconds, 73 seconds, 74 seconds, 75 seconds, etc.) from the time of determining that the call for heat is no longer present. In an implementation, during the at least 70 seconds, the induced draft blower 220 is activated for a post-purge delay having a duration of 25 seconds, and for at least 45 seconds after the post-purge delay is complete. Such continued activated state of the induced draft blower 220 causes the return air to be forced across the heat exchanger tubes to absorb remainder heat associated with the exhaust gas "EX" present in the heat exchanger tubes. However, activation of the induced draft blower 220 for a duration greater than 25 seconds decreases an overall efficiency of the gas furnace 200. In another embodiment, the controller 222 may be configured to maintain the draft inducer in an activated condition for 70 seconds from the time of determining that the call for heat is no longer present. Such continued activated state of the draft inducer causes suction of remainder of the exhaust gas "EX" that may be present in the heat exchanger tubes and venting such exhaust gas "EX" to the outdoors environment. In some embodiments, the controller 222 may be configured to maintain the induced draft blower 220 and the draft inducer in the activated condition for at least 70 seconds from stop of operation of the burner 228.

Figure 4:
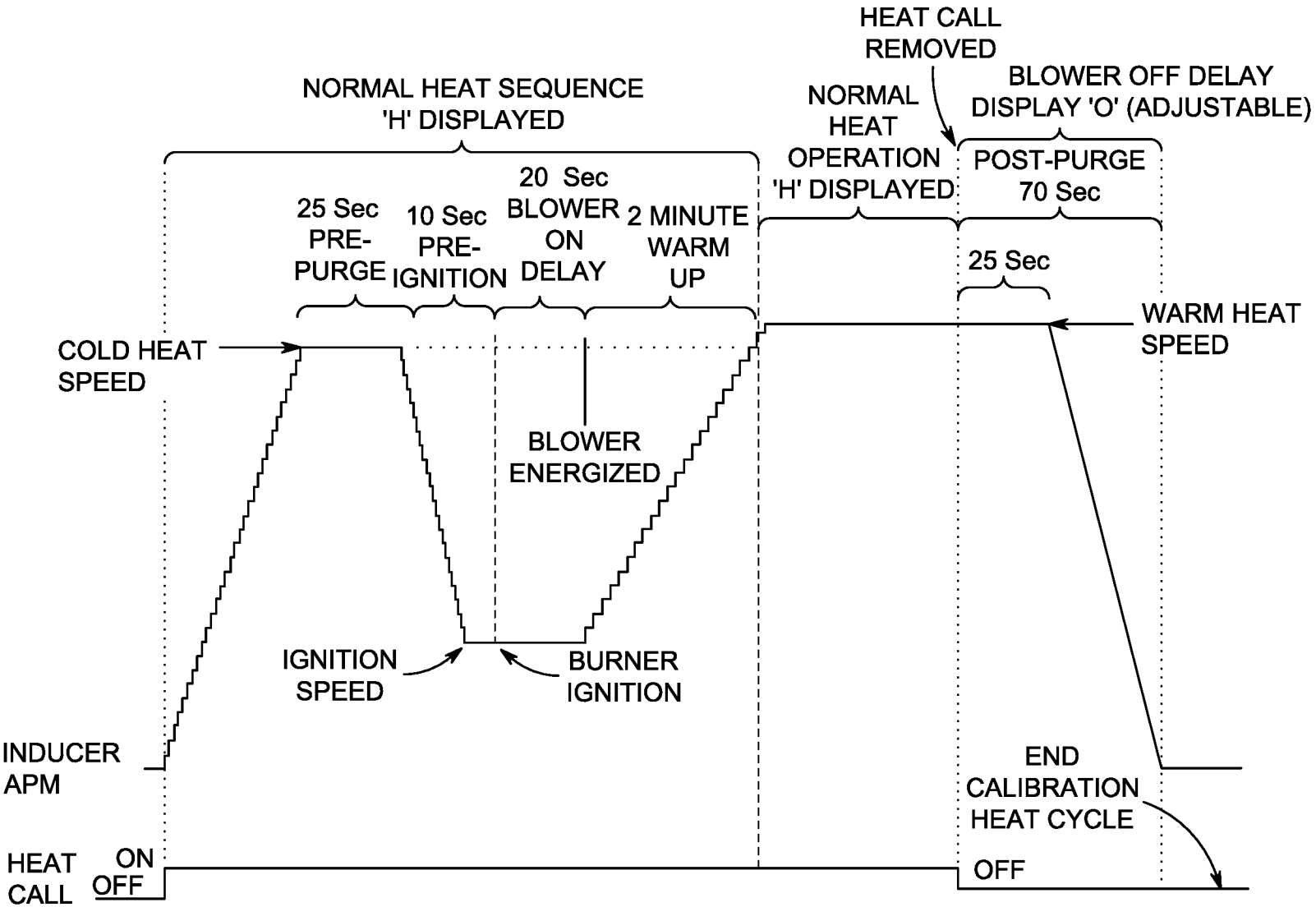
FIG. 4 is a timing diagram illustrating a post-purge delay implemented in the gas furnace in accordance with one or more embodiments of the disclosure.

FIG. 4 is a timing diagram illustrating one example embodiment of the post-purge delay, according to an aspect of the present disclosure. From the timing diagram, it can be observed that, after the call for heat is removed, the post-purge is extended from 25 seconds to 70 seconds where the induced draft blower 220 is maintained in an operating state for 70 seconds. During the 70 seconds of the induced draft blower 220 operation, the air forced, by the induced draft blower 220, across the heat exchanger tubes of the heat exchanger absorbs remainder heat from the exhaust gas flowing backward through the heat exchanger, thereby reducing temperature of the exhaust gas. In some embodiments, the temperature of the exhaust gas may be reduced to a value less than the melting point temperature of the air inlet filter 206-2. As such, the exhaust gas flowing downstream of the air inlet filter 206-2, during windy condition, may not affect the performance of the air inlet filter 206-2.

Figure 5:
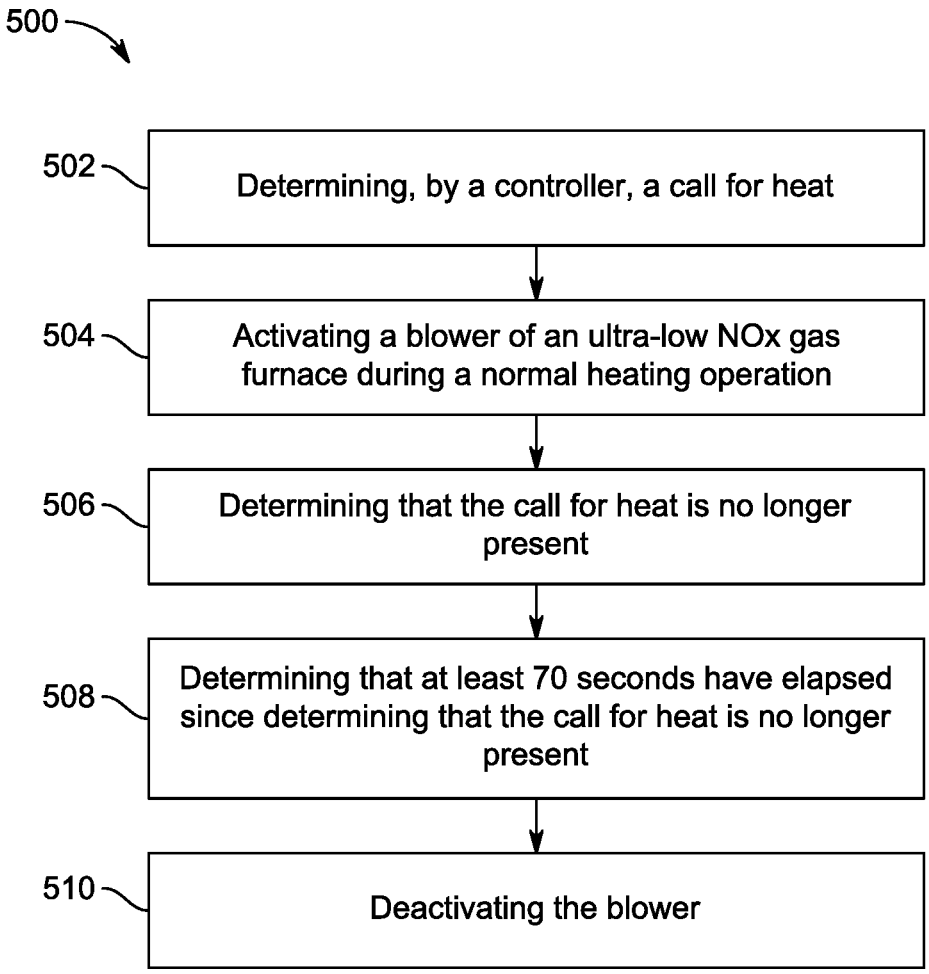
FIG. 5 illustrates a flowchart of a method for operation of the gas furnace in accordance with one or more embodiments of the disclosure.

FIG. 5 illustrates a flowchart of a method 500 for operation of an ultra-low NOx gas furnace, such as the gas furnace 200, according to an aspect of the present disclosure. The method 500 is described in conjunction with FIG. 2 through FIG. 4. At step 502, the method 500 includes determining, by the controller 222, a call for heat. In some embodiments, the call for heat may be received as an input by the controller 222, where the input is generated from a temperature sensor, or a thermostat, located in the interior of the structure 202. For example, the user in the interior of the structure 202 may set the temperature of the interior to a desired value and accordingly the input may be generated by the thermostat. In other embodiments, during winter conditions, a temperature management assembly (including the thermostat and a controller) may be configured to automatically set the temperature of the interior based on the temperature of the outdoors environment, to comfort the user.

At step 504, the method 500 includes activating the induced draft blower 220 during the normal heating operation. The controller 222 may be configured to activate the induced draft blower 220 by allowing supply of electrical energy to the induced draft blower 220. In some embodiments, the induced draft blower 220 may be activated after a predefined time from the start of operation of burner assembly of the gas furnace 200.

At step 506, the method 500 includes determining that the call for heat is no longer present. Once the temperature in the interior of the structure 202 is at least equal to the desired temperature, the thermostat may generate another input indicative of the desired temperature being reached.

At step 508, the method 500 includes determining that at least 70 seconds have elapsed since determining that the call for heat is no longer present. In some embodiment, the controller 222 is configured to determine that at least 70 seconds have elapsed since the receipt of another input from the thermostat. In some embodiments, the method 500 further includes completing a heat cycle calibration event after the at least 70 seconds have elapsed. In some embodiments, during the at least 70 seconds, the induced draft blower 220 is activated for a post-purge delay having a duration of 25 seconds, and for at least 45 seconds after the post-purge delay is complete. In some embodiments, the method 500 may include retaining the draft inducer in an activated condition for at least 70 seconds since determining that the call for heat is no longer present.

At step 510, the method 500 includes deactivating the induced draft blower 220. Upon completion of the duration of 70 seconds, the controller 222 is configured to deactivate the induced draft blower 220.

It should be apparent that the foregoing relates only to certain embodiments of the present disclosure and that numerous changes and modifications may be made herein by one of ordinary skill in the art without departing from the general spirit and scope of the disclosure.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may" unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A fuel-fired heating appliance comprising:

a combustion air pipe;

an exhaust air pipe;

an air inlet filter configured to filter air flowing through the combustion air pipe, wherein the air inlet filter is a plastic filter having a melting point temperature;

a heat exchanger coupled to the combustion air pipe and the exhaust air pipe, the heat exchanger comprising a heat exchanger tube and a induced draft blower configured to direct air toward the heat exchanger tube, wherein the air flows over the heat exchanger tube and into a supply air duct; and a controller configured to:

determine a call for heat;

activate the induced draft blower during a normal heating operation;

determine that the call for heat is no longer present;

determine that at least 70 seconds have elapsed since determining that the call for heat is no longer present; and deactivate the induced draft blower;

wherein activation of the induced draft blower causes a temperature of exhaust gas downstream of the air inlet filter to be less than the melting point temperature.

2. The fuel-fired heating appliance of claim 1, wherein the exhaust air pipe comprises a terminal end and is configured to direct the exhaust gas out of the terminal end in a horizontal direction to an outdoors environment.

3. The fuel-fired heating appliance of claim 1, wherein the combustion air pipe comprises an inlet that is disposed adjacent to the terminal end of the exhaust air pipe, and the combustion air pipe is configured to direct air inward via the inlet in a horizontal direction from the outdoors environment.

4. The fuel-fired heating appliance of claim 1, wherein during the at least 70 seconds, the induced draft blower is activated for a post-purge delay having a duration 25 seconds, and wherein the induced draft blower is activated for at least 45 seconds after the post-purge delay is complete.

5. The fuel-fired heating appliance of claim 1, wherein activation of the induced draft blower for a duration greater than 25 seconds decreases an overall efficiency of the fuel-fired heating appliance.

6. The fuel-fired heating appliance of claim 1, wherein the fuel-fired heating appliance is an ultra-low NOx gas furnace.

7. A gas furnace comprising:

a combustion air pipe;

an exhaust air pipe;

an air inlet filter configured to filter air flowing through the combustion air pipe, wherein the air inlet filter is a plastic filter having a melting point temperature;

a heat exchanger coupled to the combustion air pipe and the exhaust air pipe, the heat exchanger comprising a heat exchanger tube and an induced draft blower configured to direct air toward the heat exchanger tube, wherein the air flows over the heat exchanger tube and into a supply air duct; and a controller configured to:

determine a call for heat;

activate the induced draft blower during a normal heating operation;

determine that the call for heat is no longer present;

determine that at least 70 seconds have elapsed since determining that the call for heat is no longer present; and deactivate the induced draft blower;

wherein activation of the induced draft blower causes a temperature of exhaust gas downstream of the air inlet filter to be less than the melting point temperature.

8. The gas furnace of claim 7, wherein the exhaust air pipe comprises a terminal end and is configured to direct the exhaust gas out of the terminal end in a horizontal direction to an outdoors environment.

9. The gas furnace of claim 8, wherein the combustion air pipe comprises an inlet that is disposed adjacent to the terminal end of the exhaust air pipe, and the combustion air pipe is configured to direct air inward via the inlet in a horizontal direction from the outdoors environment.

10. The gas furnace of claim 7, wherein during the at least 70 seconds, the induced draft blower is activated for a post-purge delay having a duration of 25 seconds, and wherein the induced draft blower is activated for at least 45 seconds after the post-purge delay is complete.

11. The gas furnace of claim 7, wherein the heat exchanger is a condensing heat exchanger.

12. The gas furnace of claim 7, wherein activation of the induced draft blower for a duration greater than 25 seconds decreases an overall efficiency of the gas furnace.

13. A method for operation of an ultra-low NOx gas furnace comprising:

determining, by a controller, a call for heat;

activating a induced draft blower of the gas furnace during a normal heating operation;

determining that the call for heat is no longer present;

determining that at least 70 seconds have elapsed since determining that the call for heat is no longer present; and deactivating the induced draft blower;

wherein the gas furnace comprises an air inlet filter configured to filter air flowing through a combustion air pipe of the gas furnace, the air inlet filter being a plastic filter having a melting point temperature; and wherein activating the induced draft blower causes a temperature of exhaust gas downstream of the air inlet filter to be less than the melting point temperature.

14. The method of claim 13, further comprising:

completing a heat cycle calibration event after the at least 70 seconds have elapsed.

15. The method of claim 13, wherein activation of the induced draft blower for a duration greater than 25 seconds decreases an overall efficiency of the gas furnace.

16. The method of claim 13, wherein during the at least 70 seconds, the induced draft blower is activated for a post-purge delay having a duration 25 seconds, and wherein the induced draft blower is activated for at least 45 seconds after the post-purge delay is complete.

* * * * *